United States Patent [19]

Glover et al.

[11] 3,977,750

[45] Aug. 31, 1976

[54] RUGGEDIZED HIGH VOLTAGE CONNECTOR

[75] Inventors: Douglas Wade Glover, Harrisburg; Henry Otto Herrmann, Jr., Mount Joy, both of Pa.

[73] Assignee: AMP Incorporated, Harrisburg, Pa.

[22] Filed: Jan. 15, 1976

[21] Appl. No.: 649,380

[52] U.S. Cl. ..... 339/89 R; 339/126 RS

[51] Int. Cl.[2] ..... H01B 17/26

[58] Field of Search ..... 339/61 R, 69, 89 R, 339/89 C, 125 R, 126 R, 126 J, 126 RS, 218

[56] References Cited

UNITED STATES PATENTS

| | | | |
|---|---|---|---|
| 3,402,381 | 9/1968 | Gaw et al. | 339/89 R X |
| 3,622,946 | 11/1971 | Rogers | 339/126 RS |
| 3,892,462 | 7/1975 | Glover et al. | 339/126 |

*Primary Examiner*—Roy Lake
*Assistant Examiner*—E. F. Desmond
*Attorney, Agent, or Firm*—Gerald K. Kita

[57] ABSTRACT

A ruggedized high voltage connector suitable for mounting in a bulkhead with a variety of configurations. The connector provides a sealed plug and receptacle connection encased within a plastic sleeve having an outer metal mounting flange. The mounting flange is soldered within a metal liner for a bulkhead opening. The solder interface of the liner and flanged plastic receptacle allows various configurations of the plug and receptacle connection.

2 Claims, 3 Drawing Figures

RUGGEDIZED HIGH VOLTAGE CONNECTOR

There has been a long existing need in the prior art for a high voltage sealed electrical connection which may be bulkhead mounted in various configurations. A requirement for such a connection at the point of use is one of ease in assembly without dependence upon the shortcomings of availability of every type connector which might be needed at the point of use. In the present invention a solder interface between the readily assembled component parts of the connector permits a variety of configurations for the connector, thereby eliminating a need for stocking and transporting a variety of different preassembled connectors, the selection of which would be dictated by a particular connector configuration encountered at the point of use.

It is accordingly an object of the present invention to provide a readily assembled, sealed high voltage connector, the component parts of which are readily assembled into a variety of configurations.

Another object of the present invention is to provide a plug and socket connector for electrical leads which is sealed, ruggedly encased within protective metal and which is readily assembled for bulkhead mounting in a variety of configurations.

Other objects and many attendant advantages of the present invention will become apparent from the following detailed description taken in conjunction with the accompanying drawings.

Figure 1:
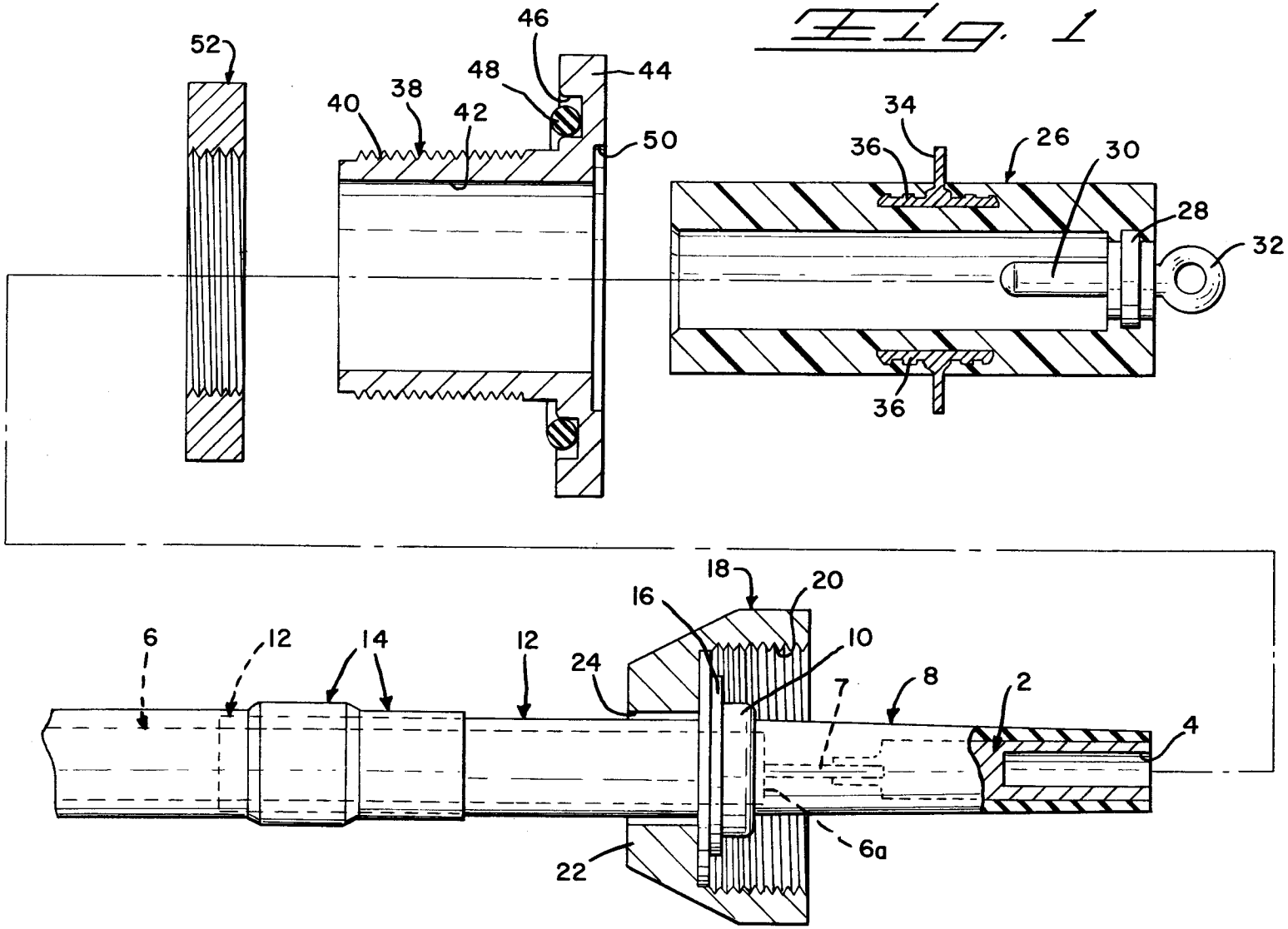
FIG. 1 is an enlarged elevation of the component parts of the connector according to the present invention with parts illustrated in section, partially cut away and in exploded configuration to illustrate the details thereof.
Figure 2:
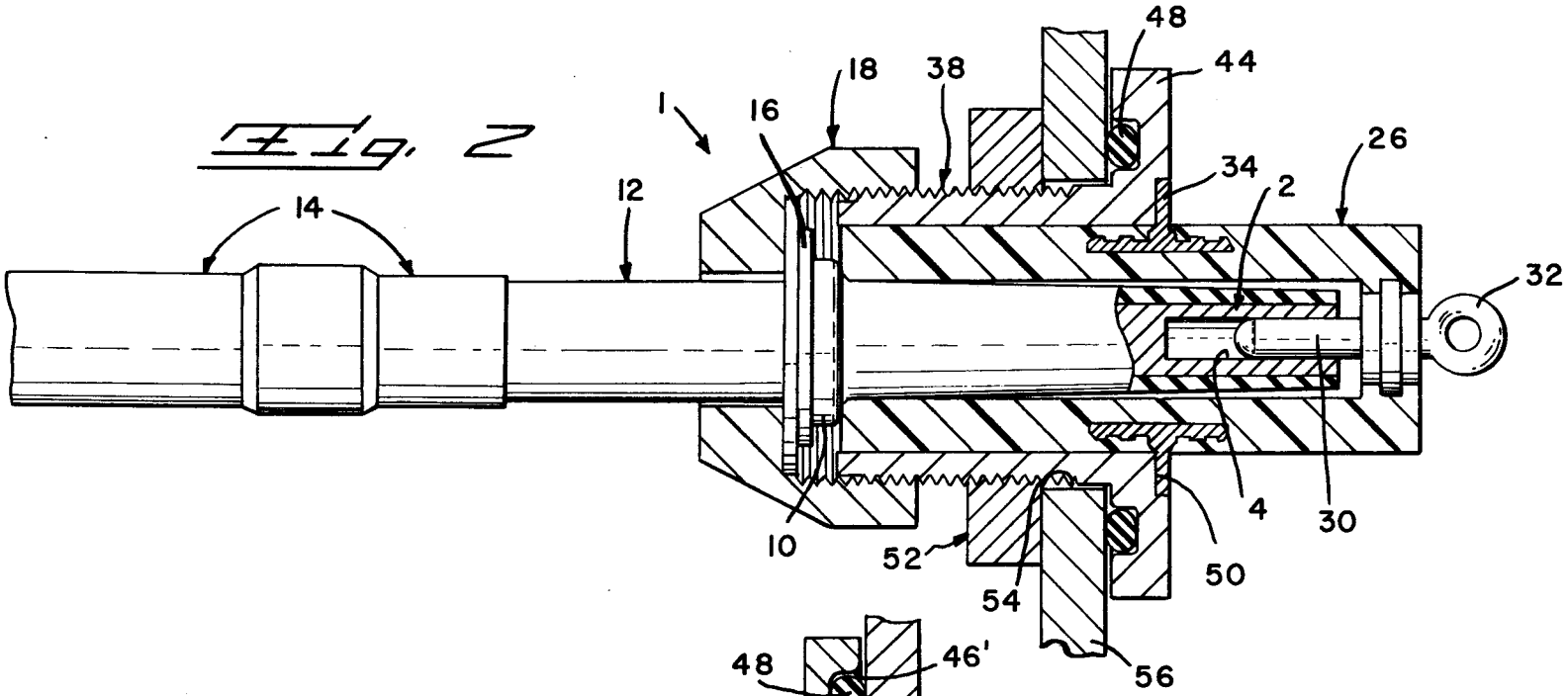
FIG. 2 is an enlarged fragmentary plan of the component parts assembled in a bulkhead.

With more particular reference to FIGS. 1 and 2 of the drawings there is illustrated generally at 1 a preferred embodiment of an electrical connector according to the present invention. A plug portion of the connector includes a conductive electrical socket type contact 2 of metal having an internal recess 4. The socket type contact 2 is electrically terminated to an insulation covered electrical lead 6. The socket type contact 2 further is enclosed by a molded elastomeric dielectric cover 8 having an integral molded outer collar 10. The sleeve 8 thus covers and sealably encloses the connection comprising the socket 2 terminated to the electrical lead 7 protruding from the end of the insulation 6*a* of the electrical lead 6. The sleeve 8, particularly the collar portion 10 thereof, is molded in adherence onto the insulation 6*a* of the electric lead 6. A rigid metal sleeve 12 is provided slidably over the electrical lead 6 and an additional sleeve 14 encircles the end of the sleeve 12 providing a strain relief for the lead 6 as it enters within the end of the sleeve 12. The sleeve 14 may be cemented in place. The other end of the sleeve 12 includes an integral outer projecting flange 16 which is stopped against the collar 10. The plug portion of the connector is further complemented by an internally threaded retaining means generally illustrated at 18 and comprising a cap of metal which is internally threaded at 20 and is provided with an inwardly projecting flange 22 stopped against the flange 16 and which has an aperture 24 therein freely received over the sleeve 12.

The receptacle portion of the connector includes a rigid dielectric sleeve 26 one end of which is integrally molded around a stepped collar 28 of an electrically conductive post or pin 30 which projects into the interior of the sleeve 26 and the other end of which is provided with a conductive ring 32. The sleeve 26 includes an outer projecting annular metal flange 34 a portion 36 of which is embedded in and molded within the dielectric sleeve 26. The receptacle portion of the connector further includes an enlarged metal sleeve 38 comprising a bulkhead linear of the outer cylindrical periphery 40 of which is threaded and the interior 42 of which freely receives the sleeve 26 therein. The bulkhead liner further is provided at one end with an enlarged integral annular outer projecting flange 44 having a first annular recess 46 therein which provides a seat for an O-ring seal 48. The flange 44 additionally is provided with a shallow annular recess 50 which is concentric with the interior 42 of the liner 38 and which provides a seat for the flange 34 of the sleeve 26. An internally threaded ring or nut 52 may be threadably received over the liner 38.

In use reference will be made to FIG. 2 of wherein the dielectric sleeve 26 is mounted within the metal sleeve or liner 38 with the flange 34 of the sleeve 26 seated within the recess 50 of the flange 44. The flanges 34 and 44 may then be sealably attached within the recess 50 thereby providing a sealed interface between the dielectric sleeve 26 and the metal sleeve or liner 38. The liner 38 may then be mounted within a feed through opening 54 of a bulkhead 56 and the ring or nut 52 may be threadably advanced along the liner to engage the bulkhead 56 and compress the O-ring 48 into sealed engagement on the bulkhead and thereby sealably encircle the bulkhead opening 54. The plug portion of the connector is readily assembled within the dielectric sleeve 26 such that the socket 2 frictionally engages and receives the conductive pin or post 30 within the recess 4. The threaded retaining means 18 may be threadably advanced along the sleeve 38 to draw the receptacle within the sleeve 26 and further to compress the molded dielectric collar 10 in sealed engagement against the sleeve 26 thereby sealably enclosing the electrical connection of the socket 2 and post or pin 30 within the sleeve 26. The ring 32 of the post 30 protrudes outwardly of the sleeve to provide an external terminal for establishing any desired electrical connection to the pin 30.

Figure 3:
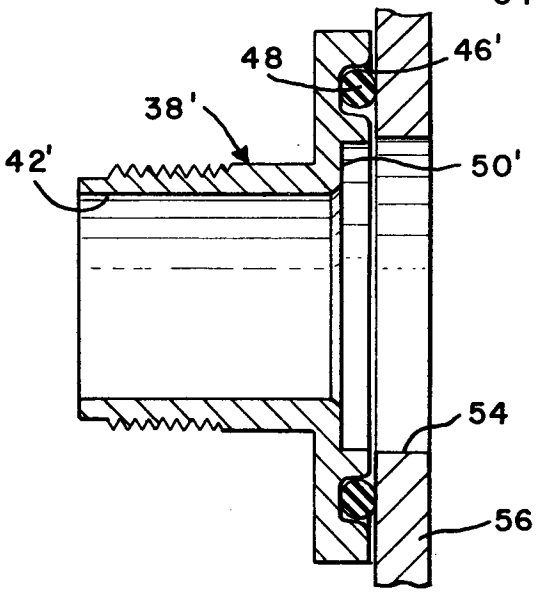
FIG. 3 is an alternative component part of the present invention allowing versatility in configuring the connector for bulkhead mounting.

FIG. 3 illustrates another preferred embodiment according to the present invention wherein an alternative feed through liner 38' has an inner diameter 42' for receiving the dielectric sleeve 26. The flange 34 of the sleeve 26 is seated within and is solderable to the liner within the recess 50' provided in the flange portion 46' of the liner 38'. It is further advantageous that the liner 38' be provided with an annular recess 46' to receive therein the sealing O-ring 48. The location of the sealing ring 48 is accordingly on the same side of the flange 46' as the recess 50' permitting the liner 38' to be mounted against a left hand side of the bulkhead 56 such that the sealing ring 48 forms a seal on the left hand side of the bulkhead. A mounting compression device for example, screws (not shown) must be applied to the metal liner 38' to draw up and retain the seal 48 and the liner 38' against the bulkhead 56.

Other modifications and embodiments differing from those specifically disclosed are intended to be covered by the spirit and scope of the appended claims.

What is claimed is:

1. A flange connector, comprising:

a dielectric sleeve provided with an outer annular metal flange, a conductive pin mounted to project into said dielectric sleeve, a metal sleeve removably receiving said dielectric sleeve, said metal sleeve having an integral outer flange and an annular recess in said flange, a conductive socket terminated to an electrical lead and enclosed within a dielectric cover, said socket removably receiving said pin and said cover removably received in said dielectric sleeve, a threaded retainer means threadably received on said metal sleeve and retaining said cover in said dielectric sleeve, and said annular metal flange being soldered in said annular recess.

2. The structure as recited in claim 1 wherein said metal sleeve includes an annular recess having an O-ring seal therein.

* * * * *